US010088190B2

(12) United States Patent
Sugiyama

(10) Patent No.: US 10,088,190 B2
(45) Date of Patent: Oct. 2, 2018

(54) CENTRAL AIR-CONDITIONING SYSTEM AND METHOD

(71) Applicant: DENSO WAVE INCORPORATED, Chita-gun, Aichi-pref. (JP)

(72) Inventor: Wataru Sugiyama, Anjo (JP)

(73) Assignee: DENSO WAVE INCORPORATED, Aichi-Pref. (JP)

( * ) Notice: Subject to any disclaimer, the term of this patent is extended or adjusted under 35 U.S.C. 154(b) by 733 days.

(21) Appl. No.: 14/218,210

(22) Filed: Mar. 18, 2014

(65) Prior Publication Data

US 2015/0044961 A1 Feb. 12, 2015

(30) Foreign Application Priority Data

Aug. 7, 2013 (JP) ..... 2013-164160

(51) Int. Cl.

| | |
|---|---|
| ***F24F 11/053*** | (2006.01) |
| ***F24F 11/30*** | (2018.01) |
| *F24F 11/56* | (2018.01) |
| *F24F 11/52* | (2018.01) |

(52) U.S. Cl.

CPC ..... *F24F 11/30* (2018.01); *F24F 11/52* (2018.01); *F24F 11/56* (2018.01); *F24F 2221/32* (2013.01)

(58) Field of Classification Search

CPC ..... F24F 11/0086; F24F 11/053; F24F 11/30; F24F 11/54; F24F 2221/32

USPC ..... 454/254, 258

See application file for complete search history.

(56) References Cited

U.S. PATENT DOCUMENTS 4,307,576 A * 12/1981 Takano ..... F25B 5/02 165/207
5,025,638 A * 6/1991 Yamagishi ..... F24F 3/044 62/180
5,161,739 A * 11/1992 Saito ..... F24D 7/00 237/67
5,247,806 A * 9/1993 Ebisu ..... F24F 3/065 706/900

(Continued)

FOREIGN PATENT DOCUMENTS

JP 56082338 A * 7/1981
JP 07318144 A * 12/1995

(Continued)

*Primary Examiner* — Kenneth Rinehart
*Assistant Examiner* — Phillip E Decker
(74) *Attorney, Agent, or Firm* — Oliff PLC

(57) ABSTRACT

In a central air-conditioning system and method, a distribution mechanism distributes warm air or cool air generated by an air-conditioning unit to a plurality of rooms in a house. A control device controls the distribution mechanism to adjust a temperature of each room. A plurality of room terminals are provided as a device each dedicated to a room. Each room terminal receives an input of a preset temperature for the room and detects temperature of the room, and outputs the received preset temperature and the detected room temperature to the control device. The control device judges whether or not a specified room terminal is mounted in a specified room, based on a transition of control of the distribution mechanism in the specified room and a change in the detected temperature. The control device stops air-conditioning the specified room when judged that the specified room terminal is not mounted in the specified room.

11 Claims, 9 Drawing Sheets

(56) References Cited

U.S. PATENT DOCUMENTS

| | | | | |
|---|---|---|---|---|
| 5,276,630 | A * | 1/1994 | Baldwin | F24F 11/00 700/276 |
| 5,602,758 | A * | 2/1997 | Lincoln | F24F 11/006 165/205 |
| 7,848,852 | B2 * | 12/2010 | Sakae | F24F 11/30 700/276 |
| 9,092,039 | B2 * | 7/2015 | Fadell | F24F 11/30 |
| 9,851,728 | B2 * | 12/2017 | Matsuoka | F24F 11/0086 |
| 2005/0270151 | A1 * | 12/2005 | Winick | G08B 17/00 340/539.1 |
| 2006/0097063 | A1 * | 5/2006 | Zeevi | F24F 11/0086 236/49.3 |
| 2013/0133404 | A1 * | 5/2013 | Patel | F24F 11/30 73/29.02 |
| 2013/0154839 | A1 * | 6/2013 | Barton | F24F 12/001 340/584 |
| 2013/0158717 | A1 * | 6/2013 | Zywicki | F24F 11/30 700/276 |

FOREIGN PATENT DOCUMENTS

| | | |
|---|---|---|
| JP | A-11-294839 | 10/1999 |
| JP | 2012242003 A * | 12/2012 |

* cited by examiner

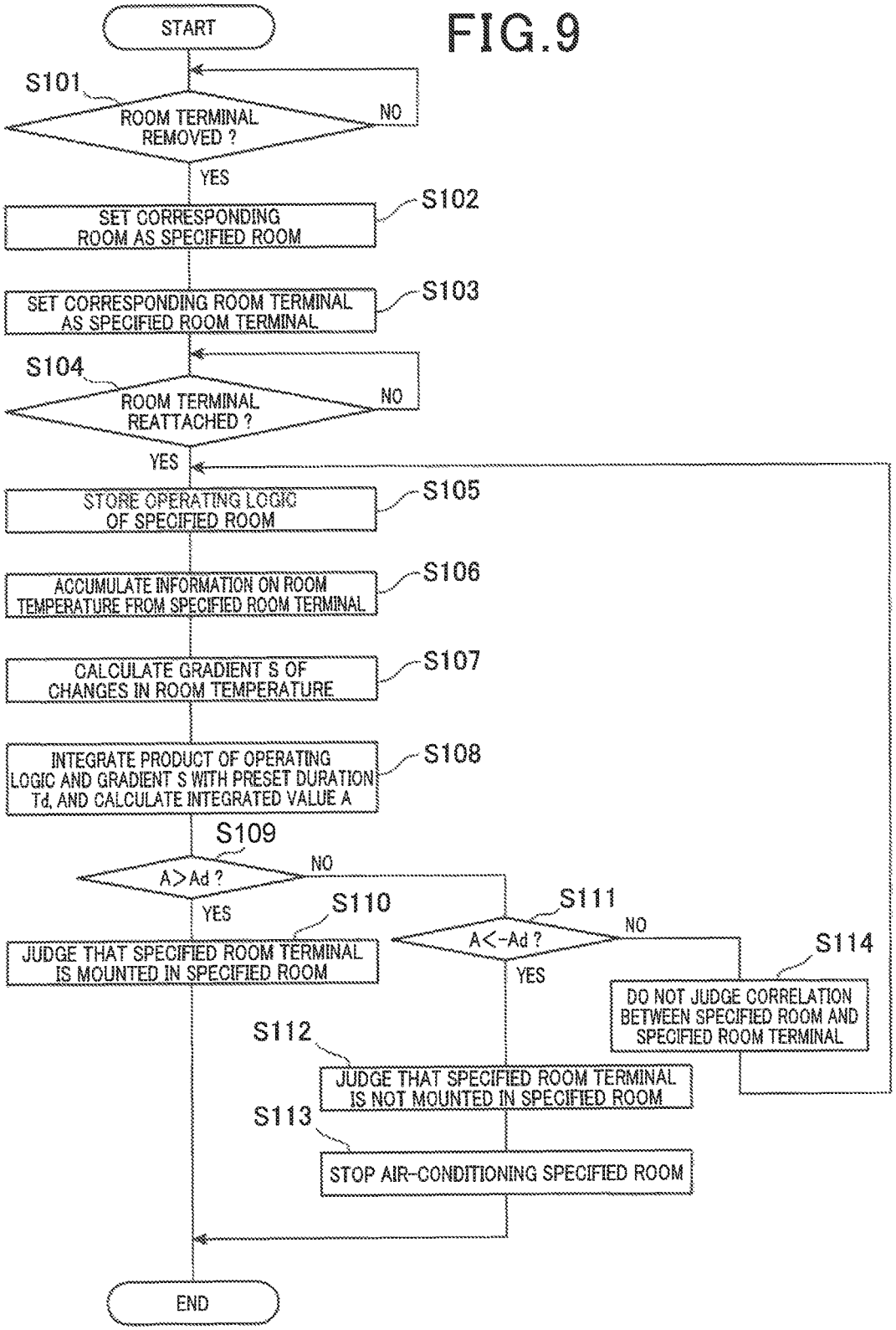
FIG.9
START
S101
ROOM TERMINAL REMOVED ?
NO
YES
S102
SET CORRESPONDING ROOM AS SPECIFIED ROOM
S103
SET CORRESPONDING ROOM TERMINAL AS SPECIFIED ROOM TERMINAL
S104
ROOM TERMINAL REATTACHED ?
NO
YES
S105
STORE OPERATING LOGIC OF SPECIFIED ROOM
S106
ACCUMULATE INFORMATION ON ROOM TEMPERATURE FROM SPECIFIED ROOM TERMINAL
S107
CALCULATE GRADIENT S OF CHANGES IN ROOM TEMPERATURE
S108
INTEGRATE PRODUCT OF OPERATING LOGIC AND GRADIENT S WITH PRESET DURATION Td, AND CALCULATE INTEGRATED VALUE A
S109
A>Ad ?
NO
YES
S110
JUDGE THAT SPECIFIED ROOM TERMINAL IS MOUNTED IN SPECIFIED ROOM
S111
A<-Ad ?
NO
YES
S114
DO NOT JUDGE CORRELATION BETWEEN SPECIFIED ROOM AND SPECIFIED ROOM TERMINAL
S112
JUDGE THAT SPECIFIED ROOM TERMINAL IS NOT MOUNTED IN SPECIFIED ROOM
S113
STOP AIR-CONDITIONING SPECIFIED ROOM
END

CENTRAL AIR-CONDITIONING SYSTEM AND METHOD

CROSS-REFERENCE TO RELATED APPLICATION

This application is based on and claims the benefit of priority from Japanese Patent Application No. 2013-164160, filed Aug. 7, 2013, the disclosure of which is incorporated herein in its entirety by reference.

BACKGROUND

Technical Field

The present invention relates to a central air-conditioning system that air-conditions a plurality of rooms in a house.

Related Art

A central air-conditioning system is known that air-conditions a plurality of rooms in a house using a single air-conditioning unit (see, for example, JP-A-H11-294839). In the central air-conditioning system, a distribution mechanism, such as a damper, is provided in each room of the house. Each distribution mechanism is controlled, thereby controlling the temperature for each room. In an instance in which a plurality of rooms to be subjected to air-conditioning is present in the house, preset temperature and room temperature are not necessarily the same for all rooms.

For example, in a typical house, the intended purpose differs for each of the plurality of rooms. In addition, the number of people present in the room also differs for each room. Moreover, the physical locations of the plurality of rooms also differ. Therefore, the environment, such as sunlight, also differs. As a result, it is typical for the plurality of rooms to have differing preset temperatures and room temperatures.

In the central air-conditioning system, a room terminal is mounted in each room. The room terminal receives an input of the preset temperature of the room. The room terminal also detects the temperature of the room. The room terminal outputs the received preset temperature and the detected temperature to a control device. The control device controls the distribution mechanism of each room based on the preset temperature and room temperature received from the room terminal of each room. In this way, in the central air-conditioning system, the room and the room terminal are associated with each other, one to one. In other words, the room terminal is provided as a device that is dedicated to the associated room.

However, during use, the room terminal may be removed from the room to which the room terminal is dedicated. For example, the room terminal may use a battery as a power source. In this instance, during battery replacement, the room terminal may be switched with a room terminal of a room other than the room to which the room terminal is dedicated. In particular, the room terminal is more easily moved from the room to which the room terminal is dedicated to another room, as the room terminal becomes more compact and has higher portability. In this way, when the room terminal is switched with that of a room other than the room to which the room terminal is dedicated, a difference occurs in the temperature detected by the room terminal and the temperature of the room to which the room terminal is dedicated.

For example, when the room terminal is switched with that of a room next to the room to which the room terminal is dedicated, the room terminal detects the temperature of the next room. Therefore, the actual temperature of the room to which the room terminal is dedicated and the temperature of the (next) room detected by the room terminal differ. As a result, when the room terminals are switched, the temperature of each room in the house cannot be controlled. A problem occurs in that excessive or insufficient air-conditioning occurs.

SUMMARY

It is thus desired to provide a central air-conditioning system that judges whether or not a room terminal is mounted in a room to which the room terminal is dedicated, and prevents excessive or insufficient air-conditioning.

An exemplary embodiment provides a central air-conditioning system that includes a single air-conditioning unit, a distribution mechanism, a control device, and room terminals.

The distribution mechanism distributes warm air or cool air to a plurality of rooms in a house. The warm air or cool air is generated by the air-conditioning unit. The control device controls the distribution mechanism to adjust the temperature of each room. Each room terminal is provided as a dedicated device for each of the plurality of rooms. Each room terminal receives an input of a preset temperature for the room and detects the temperature of the room. The room terminal then outputs the received preset temperature and the detected room temperature to the control device.

The control device includes correspondence judging means and air-conditioning stopping means. Regarding a correspondence between an arbitrary specified room among the plurality of rooms and a specified room terminal that is dedicated to the specified room, the correspondence judging means judges whether or not the specified room terminal is mounted in the specified room. The correspondence judging means makes the judgment based on the transition of control of the distribution mechanism in the specified room and the changes in temperature detected by the specified room terminal. When judged by the correspondence judging means that the specified room terminal is not mounted in the corresponding specified room, the air-conditioning stopping means stops air-conditioning the specified room.

According to the exemplary embodiment, the correspondence judging means judges whether or not the specified room terminal is mounted in the specified room. A room terminal is provided in each of the plurality of rooms in the house. The room terminal is dedicated to the room. Therefore, a specified room terminal corresponds, one to one, to a specified room that is an arbitrary room among the plurality of rooms.

The correspondence judging means judges whether or not the specified room terminal is mounted in the specified room based on the transition of control of the distribution mechanism in the specified room and the changes in temperature of the specified room detected by the specified room terminal. In other words, when the specified room terminal is mounted in a room other than the specified room, regardless of the distribution mechanism operating normally in the specified room, the temperature of the specified room detected by the specified room terminal may not change. Alternatively, regardless of the distribution mechanism being stopped or not changing, the temperature of the specified room detected by the specified room terminal may change.

As described above, when taking into consideration the preset temperature and room temperature differing for each of the plurality of rooms in the house, when the specified room terminal is mounted in a room other than the specified room, the probability is very low that the changes in room temperature in the specified room match the changes in room temperature detected by the specified room terminal. Therefore, when judging whether or not the specified room terminal is mounted in the specified room based on the changes in temperature of the specified room detected by the specified room terminal, whether or not the specified room terminal is correctly mounted can be judged with high accuracy.

When the correspondence judging means judges that the specified room terminal is not mounted in the specified room, the air-conditioning stopping unit stops air-conditioning the specified room. Therefore, air-conditioning of the specified room is terminated when a mounting error of the room terminal occurs. As a result, excessive or insufficient air-conditioning of the specified room can be prevented.

According to the exemplary embodiment, the room terminal may include a detecting means that judges whether or not the room terminal has been removed from the corresponding room. When the detecting means detects that the room terminal has been removed, the control device may set the relevant room as the specified room and the room terminal corresponding to the specified room as the specified room terminal.

In other words, the control device judges whether or not the specified room terminal is mounted in the specified room with the removal of the room terminal as a trigger. As long as the specified room terminal is attached to the specified room, the specified room terminal does not detect the temperature of a room other than the specified room.

On the other hand, as a result of the specified room terminal being removed from the specified room, the possibility arises that the specified room terminal has been switched with the room terminal of another room. Therefore, the control device judges whether or not the specified room terminal and the specified room match with the removal of the room terminal as the trigger. The removal of the room terminal leads to movement of the room terminal. Therefore, unnecessary control can be omitted.

In the exemplary embodiment, the preset temperature and the detected temperature may be communicated wirelessly between the room terminal and the control device. Here, when the room terminal and the control device are connected wirelessly, compared to a wired connection, mobility and portability of the room terminal improve. Therefore, when the room terminal and the control device are connected wirelessly, compared to a wired connection, the possibility increases that the room terminal becomes switched with a room terminal of a room other than the room to which the room terminal is dedicated.

However, erroneous correspondence between the room terminals and the rooms can be prevented with certainty, even when the room terminals and the control device are connected wirelessly and switching among the room terminals easily occurs. As a result, excessive or insufficient air-conditioning of the specified room can be prevented.

In the exemplary embodiment, notifying means may be provided that gives notification when the specified room terminal is not mounted in the corresponding specified room. The notifying means gives visual or audio notification that the specified room terminal is not mounted in the corresponding specified room. In addition, the notifying means may notify an external device, such as a mobile terminal, that the specified room terminal is not mounted in the corresponding specified room. As a result, the user can be notified that the specified room is not being air-conditioned.

In the exemplary embodiment, the correspondence judging means may judge whether or not the specified room terminal is mounted in the specified room, based on information accumulated over a preset duration. In other words, the correspondence judging means uses information accumulated over a specified preset duration, rather than that of a short-term accumulation. Therefore, the effects of changes in temperature caused by disturbances in the specified room can be reduced. The temperature of a room, such as the specified room, changes as a result disturbances, such as a door being opened or direct sunlight entering the room, in addition to air-conditioning.

If whether or not the specified room terminal is mounted in the specified room is judged on the basis of short-term changes in temperature, the judgment may be affected by these disturbances. Therefore, the effects of disturbances can be eliminated by use of information accumulated over the preset duration. As a result, the relationship between the specified room terminal and the specified room can be judged with high accuracy. Excessive or insufficient air-conditioning of the specified room can be prevented with high accuracy.

BRIEF DESCRIPTION OF THE DRAWINGS

In the accompanying drawings:

FIG. 9 is a schematic diagram of a flow of processes performed by the central air-conditioning system according to the embodiment.

DESCRIPTION OF THE EMBODIMENTS

An embodiment of a central air-conditioning system will hereinafter be described with reference to the drawings.

Figure 1:
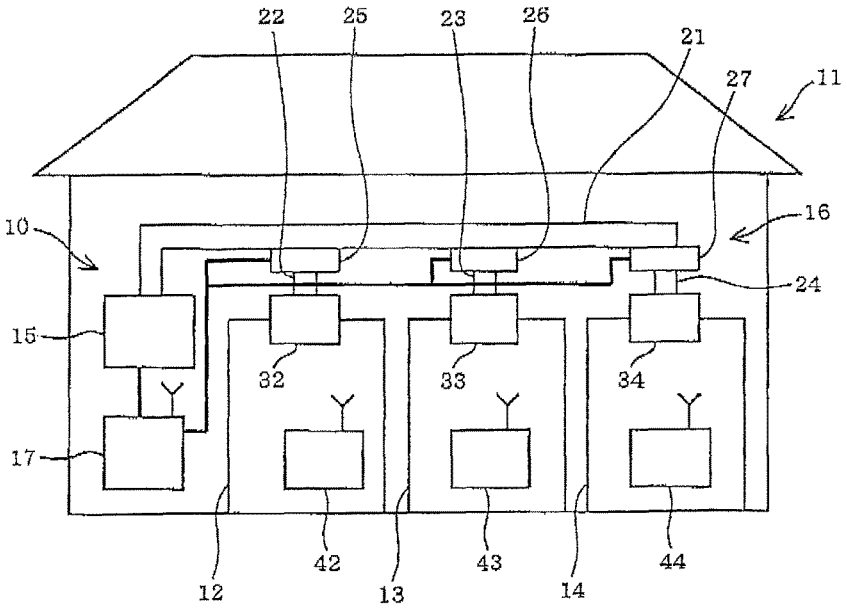
FIG. 1 is a schematic diagram of a house to which a central air-conditioning system according to an embodiment is applied.

First, a configuration of the central air-conditioning system will be described with reference to FIG. 1. A central air-conditioning system 10 is provided in a house 11. The house 11 has a plurality of rooms 12, 13, and 14. The central air-conditioning system 10 includes an air-conditioning unit 15, a distribution mechanism 16, and a control device 17.

The air-conditioning unit 15 is configured by a heat pump-type heat exchanger or the like. The heat pump-type heat exchanger includes, for example, a compressor, an evaporator, and heat exchanging fins (not shown). The air-conditioning unit 15 may include a heater, a Peltier device, and the like, in addition to the heat pump. In addition, the air-conditioning unit 15 has a fan (not shown) that blows warm air or cool air generated by the heat exchanger or the like.

The central air-conditioning system 10 air-conditions the plurality of rooms 12, 13, and 14 in the house 11 using the single air-conditioning unit 15. In this instance, the house 11 may have two or more air-conditioning units 15. In other words, the central air-conditioning system 10 according to the present embodiment refers to a system for air-conditioning a plurality of rooms, that is, two or more rooms using a single air-conditioning unit 15.

The distribution mechanism 16 distributes the warm air or cool air generated by the air-conditioning unit 13 to the rooms 12, 13, and 14. In an instance in which the house 11 has three rooms 12, 13, and 14 as according to the present embodiment, the distribution mechanism 16 has a main duct 21 and branching ducts 22, 23, and 24 that branch from the main duct 21. In addition, the distribution mechanism 16 has dampers 25, 26, and 27. The dampers 25, 26, and 27 are respectively provided in the branching ducts 22, 23, and 24. The damper 25 opens and closes the branching duct 22. The damper 26 opens and closes the branching duct 23. The damper 27 opens and closes the branching duct 24.

The warm air or cool air generated by the air-conditioning unit 15 is sent to the main duct 21 by a fan (not shown). The dampers 25, 26, and 27 respectively open and close the branching ducts 22, 23, and 24. As a result, the amount of flow of the warm air or cool air supplied to each room 12, 13, and 14 is adjusted. An end portion of the branching duct 22 on the room 12 side is an air-blowing outlet 32. In a similar manner, an end portion of the branching duct 23 on the room 13 side is an air-blowing outlet 33. An end portion of the branching duct 24 on the room 14 side is an air-blowing outlet 34.

The control device 17 controls the damper 25, the damper 26, and the damper 27. Specifically, the control device 17 controls the opening and closing of the branching duct 22 by the damper 25. The control device 17 also controls the opening and closing of the branching duct 23 by the damper 26. The control device 17 also controls the opening and closing of the branching duct 24 by the damper 27.

In addition, the control device 17 controls the air-conditioning unit 15 and the fan (not shown) that blows out the warm air or cool air generated by the air-conditioning unit 15. In other words, the control device 17 controls the opening and closing of the damper 25, the damper 26, and the damper 27, the operation of the air-conditioning unit 15, and the rotation of the fan. The control device 17 thereby adjusts the amount of flow of the warm air or cool air supplied to each room 12, 13, and 14 from the air-conditioning unit 15.

As a result, the control device 17 individually adjusts the temperatures of the room 12, the room 13, and the room 14. For example, when the temperature of the room 12 is increased during heating, the control device 17 strengthens the operation of the air-conditioning unit 15. In addition, the control device 17 widens the opening of the damper 25. As a result, the warm air generated by the air-conditioning unit flows through the main duct 21 and the branching duct 22 into the room 12.

In addition to the components described above, the central air-conditioning system 10 includes room terminals 42, 43, and 44. The room terminals 42, 43, and 44 each include a setting switch and a temperature sensor. The setting switch is used to input a preset temperature for a room. The temperature sensor detects the temperature of the room. The room terminals 42, 43, and 44 are respectively provided in the rooms 12, 13, and 14 as dedicated devices.

In other words, the room terminal 42 is a device dedicated to the room 12. The room terminal 42 receives the preset temperature for the room 12 and detects the temperature of the room 12. In a similar manner, the room terminal 43 is a device dedicated to the room 13. The room terminal 43 receives the preset temperature for the room 13 and detects the temperature of the room 13. Furthermore, the room terminal 44 is a device dedicated to the room 14. The room terminal 44 receives the preset temperature for the room 14 and detects the temperature of the room 14.

The room terminals 42, 43, and 44 are capable of communicating with the control device 17. The room terminals 42, 43, and 44 each output the received preset temperature and detected room temperature to the control device 17.

A configuration of the room terminals 42, 43, and 44 will be described in detail. The room terminals 42, 43, and 44 of the respective rooms 12, 13, and 14 share a common configuration. Therefore, the room terminal 42 provided in the room 12 will be described with reference to FIGS. 2 and 3.

Figure 2:
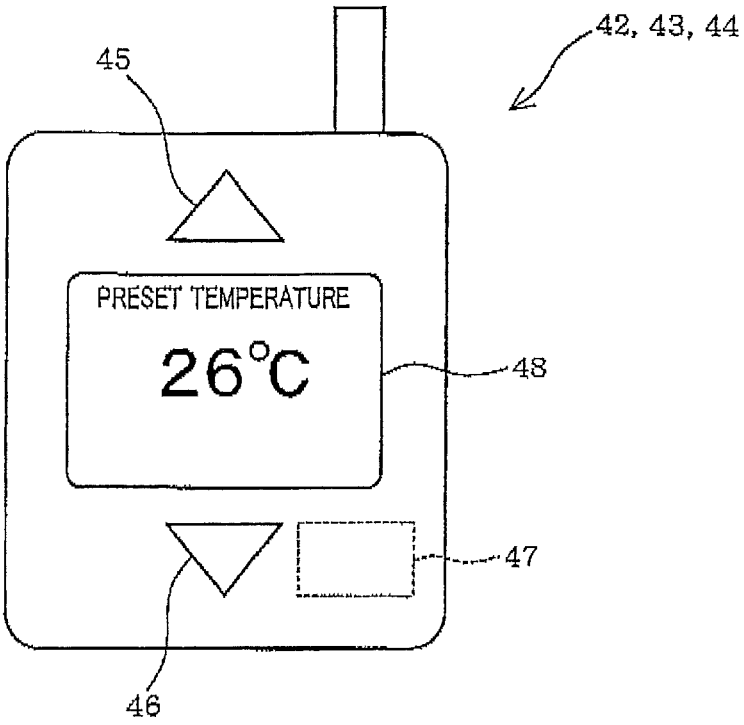
FIG. 2 is a schematic diagram of a room terminal of the central air-conditioning system according to the embodiment.

As shown in FIG. 2, the room terminal 42 has setting switches 45 and 46, a temperature sensor 47, and a display unit (including notifying means) 48. A user inputs the preset temperature using the setting switches 45 and 46 of the room terminal 42. For example, the preset temperature increases by 0.5° C. when the user presses the setting switch 45. In addition, the preset temperature decreases by 0.5° C. when the user presses the setting switch 46. In this way, the room terminal 42 receives an input of the preset temperature of the room 12.

The temperature sensor 47 detects, as the room temperature, the temperature of the room 12 in which the room terminal 42 is mounted. The display unit 48 displays the preset temperature that has been inputted using the setting switches 45 and 46. The display unit 48 may display arbitrary pieces of information, such as the current time or room temperature, in addition to the preset temperature.

Figure 3:
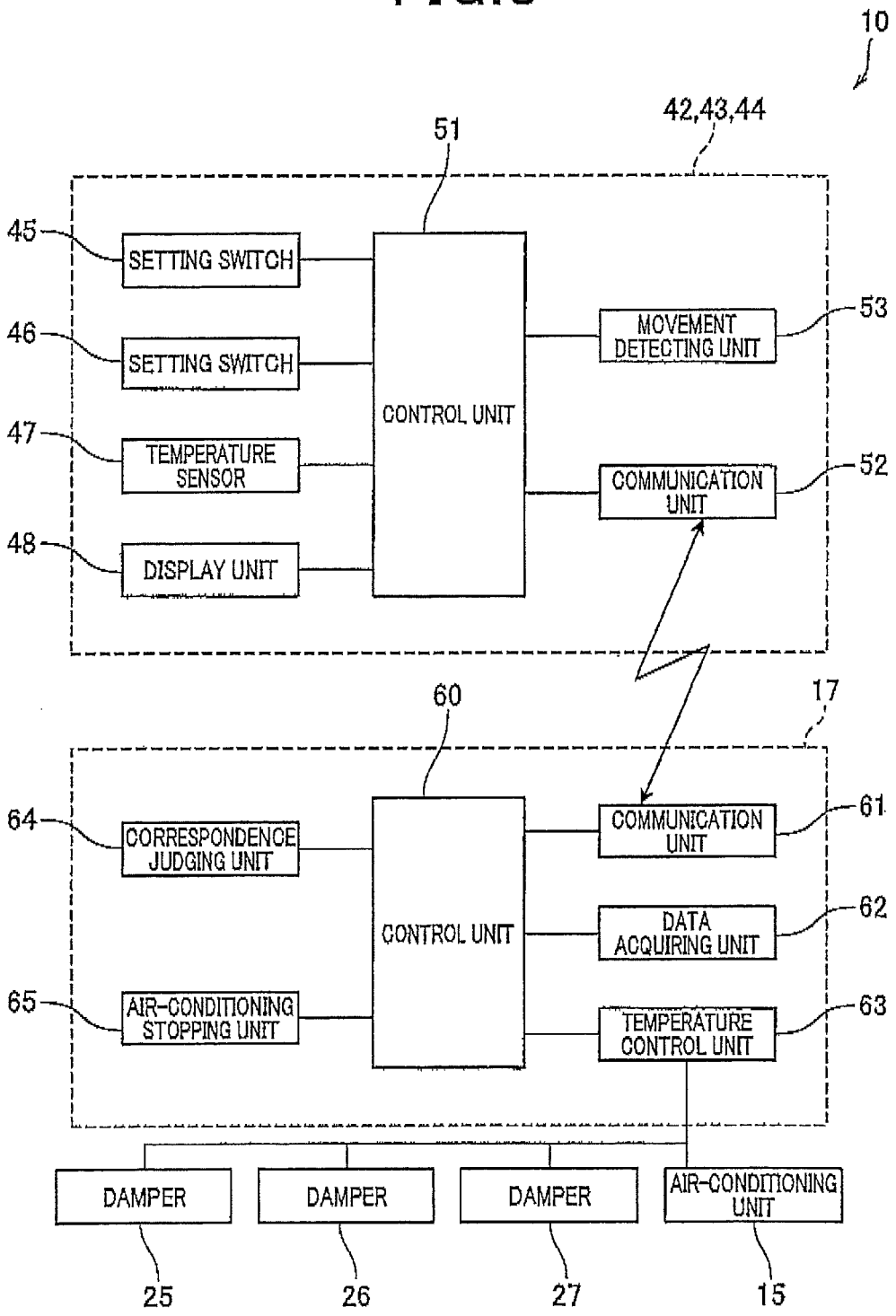
FIG. 3 is a schematic block diagram of the central air-conditioning system according to the embodiment.

In addition, FIG. 3 shows an electrical configuration of the room terminal 42. The room terminal 42 includes a control unit 51, a communication unit 52, and a movement detecting unit (corresponding to detecting means) 53, in addition to the setting switches 45 and 46, the temperature sensor 47, and the display unit 48. The temperature sensor 47 outputs the detected temperature to the control unit 51 as an electrical signal. The room terminal 42 is communicably connected to the control device 17.

The control unit 51 is configured by a microcomputer. The microcomputer includes a central processing unit (CPU), a read-only memory (ROM), and a random access memory (RAM). The control unit 51 controls the room terminal 42 by running a computer program that is stored in the ROM. The control unit 51 operates with a battery (not shown) as a power source. According to the present embodiment, the room terminal 42 communicates with the control device 17 wirelessly. The present temperature is received through the setting switches 45 and 46. The room temperature is detected by the temperature sensor 47. The control unit 51 then outputs the preset temperature and the room temperature to the control device 17, via the communication unit 52.

The control device 17 and the room terminal 42 are communicably connected by a short-range wireless communication method, such as a wireless local area network (LAN). When communicating with the control device 17, for example, the room terminal 42 adds a unique identification signal to the data to be outputted, and outputs the data to the control device 17. The unique identification signal indicates that the room terminal 42 is a dedicated terminal of the room 12. Alternatively, the room terminal 42 outputs the data to the control device 17 on a unique frequency. As a result, the control device 17 recognizes the various pieces of information received from the room terminal 42 as information related to the room 12.

Figure 4A:
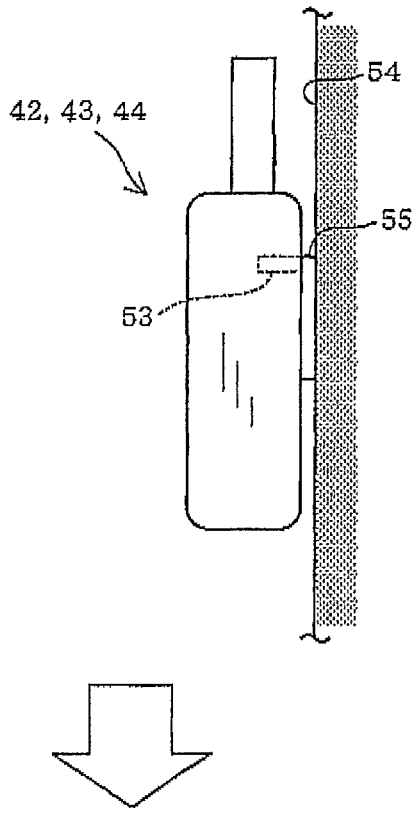
FIGS. 4A and 4B are schematic diagrams of a room terminal of the central air-conditioning system according to the embodiment.
Figure 4B:
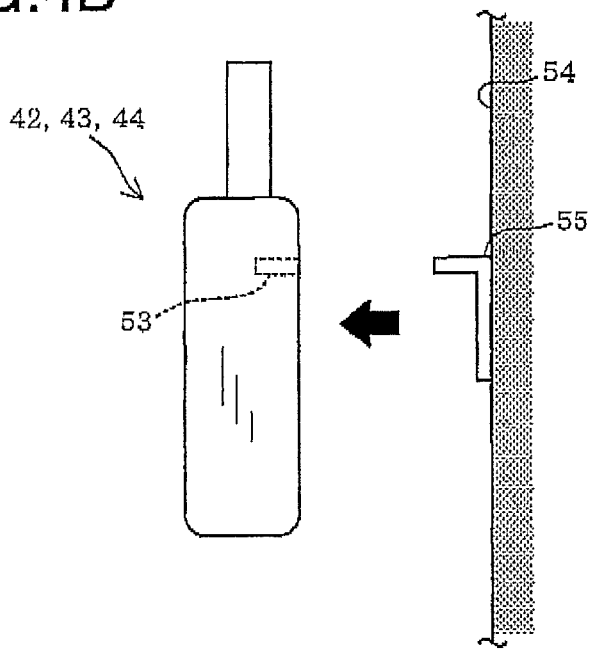

The movement detecting unit 53 detects whether or not the room terminal 42 has been removed from the corresponding room 12. The movement detecting unit 53 is configured by, for example, a mechanical switch, as shown in FIGS. 4A and 4B. In other words, the movement detecting unit 53 detects engagement with a projection 55. The projection 55 projects from a wall surface 54 in each room 12, 13, and 14.

When the room terminal 42 is removed from the wall surface 54, the engagement between the movement detecting unit 53 and the projection 55 is released. When the engagement with the projection 55 is released in this way, the movement detecting unit 53 detects that the room terminal 42 has been removed from the wall surface 54. The movement detecting unit 53 then outputs a notification that the room terminal 42 has been removed to the control device 17.

The movement detecting unit 53 is not limited to the above-described example shown in FIGS. 4A and 4B. The movement detecting unit 53 may be configured such that sensors are provided in both the room terminal 42 and the projection 55. The sensors detect contact between the room terminal 42 and the projection 55. The room terminal 42 and the projection 55 may then independently detect detachment of the room terminal 42.

In addition, the movement detecting unit 53 may be configured such that the room terminal 42 is provided with a sensor that detects detachment. The room terminal 42 may then independently detect removal. In addition, the room terminal 42 may request that the control device 17 recognize the room corresponding to the room terminal 42 that has detected the removal as a specified room.

Furthermore, the movement detecting unit 53 may be an acceleration sensor or the like, instead of the mechanical switch. The acceleration sensor detects the movement of the room terminal 42 itself based on acceleration applied to the room terminal 42. The movement detecting unit 53 is equivalent to detecting means in the scope of the claims. Detailed configurations of each unit of the room terminal 43 and the room terminal 44 are similar to those of the room terminal 42, described above.

As shown in FIG. 3, the control device 17 includes a control unit 60, a communication unit 61, a data acquiring unit 62, a temperature control unit 63, a correspondence judging unit (corresponding to correspondence judging means) 64, and an air-conditioning stopping unit (corresponding to air-conditioning stopping means) 65.

The control unit 60 is configured by a microcomputer (not shown). The microcomputer includes a CPU, a ROM, and a RAM. The control unit 60 controls the overall central air-conditioning system 10, such as the control device 17, by running a computer program stored in the ROM. In addition, the control unit 60 actualizes the data acquiring unit 62, the temperature control unit 63, the correspondence judging unit 64, and the air-conditioning stopping unit 65 by software, by running a computer program.

The data acquiring unit 62, the temperature control unit 63, the correspondence judging unit 64, and the air-conditioning stopping unit 65 may be actualized by hardware, or a combination of hardware and software, in addition to software.

The communication unit 61 communicates with the room terminals 42, 43, and 44. The communication unit 61 communicates with the room terminals 42, 43, and 44 wirelessly, as described above. The data acquiring unit 62 acquires the preset temperatures and the room temperatures of the rooms 12, 13, and 14 from the respective room terminals 42, 43, and 44, wirelessly.

The temperature control unit 63 drives the air-conditioning unit 15 and the dampers 25, 26, and 27 based on the preset temperatures and the room temperatures of the rooms 12, 13, and 14 acquired by the data acquiring unit 62. As a result, the temperature control unit 63 controls the temperatures of the rooms 12, 13, and 14. In other words, the temperature control unit 63 controls the air-conditioning unit 15 and the dampers 25, 26, and 27 such that the respective temperatures of the rooms 12, 13, and 14 become the preset temperatures that have been set hi advance.

The correspondence judging unit 64 judges whether or not the room terminals 42, 43, and 44 are placed in the corresponding rooms 12, 13, and 14. As described above, the room terminal 42 is set as a device dedicated to the room 12. In a similar manner, the room terminal 43 is set as a device dedicated to the room 13. The room terminal 44 is set as a device dedicated to the room 14.

However, the room terminals 42, 43, and 44 communicate wirelessly with the control device 17. Therefore, the room terminals 42, 43, and 44 are not fixed to the respective rooms 12, 13, and 14 to which the room terminals 42, 43, and 44 are respectively dedicated. The room terminals 42, 43, and 44 are portable.

Therefore, when any of the room terminals 42, 43, and 44 is switched with that of a room other than, the corresponding room, or when multiple room terminals 42, 43, and 44 are present in a room, discrepancies occur between the room temperatures detected by the room terminals 42, 43, and 44, and the room temperatures of the rooms 12, 13, and 14 to be controlled by the control device 17.

For example, the room terminal 42 and the room terminal 43 are switched. In this instance, the room terminal 42 detects the temperature of the room 13, rather than the temperature of the room 12. Therefore, the control device 17 controls the temperature of the room 12 based on the temperature of the room 13 detected by the room terminal 42.

As a result, the temperature of the room 12 cannot be controlled to the intended preset temperature. Therefore, the correspondence judging unit 64 judges whether or not the room terminals 42, 43, and 44 are mounted in the corresponding rooms 12, 13, and 14 to which the room terminals 42, 43, and 44 are respectively dedicated.

When judged by the correspondence judging unit 64 that any of the room terminals 42, 43, and 44 is not mounted in the corresponding room 12, 13, or 14 to which the room terminal 42, 43, or 44 is dedicated, the air-conditioning stopping unit 65 stops air-conditioning the corresponding room 12, 13, or 14. For example, when the correspondence judging unit 64 judges that the room terminal 42 is not mounted in the room 12, the air-conditioning stopping unit 65 stops air-conditioning the room 12.

Details of operations performed by the correspondence judging unit 64 according to the present embodiment will be described hereafter.

(Normal Mounting)

First, temperature change occurring when the room terminals 42, 43, and 44 are mounted in a normal state such as to respectively correspond to the rooms 12, 13, and 14 to which the room terminals 42, 43, and 44 are respectively dedicated will be described with reference to FIG. 5. In other words, in this normal mounted state, the room terminal 42 is mounted in the room 12. The room terminal 43 is mounted in the room 13. The room terminal 44 is mounted in the room 14.

Figure 5:
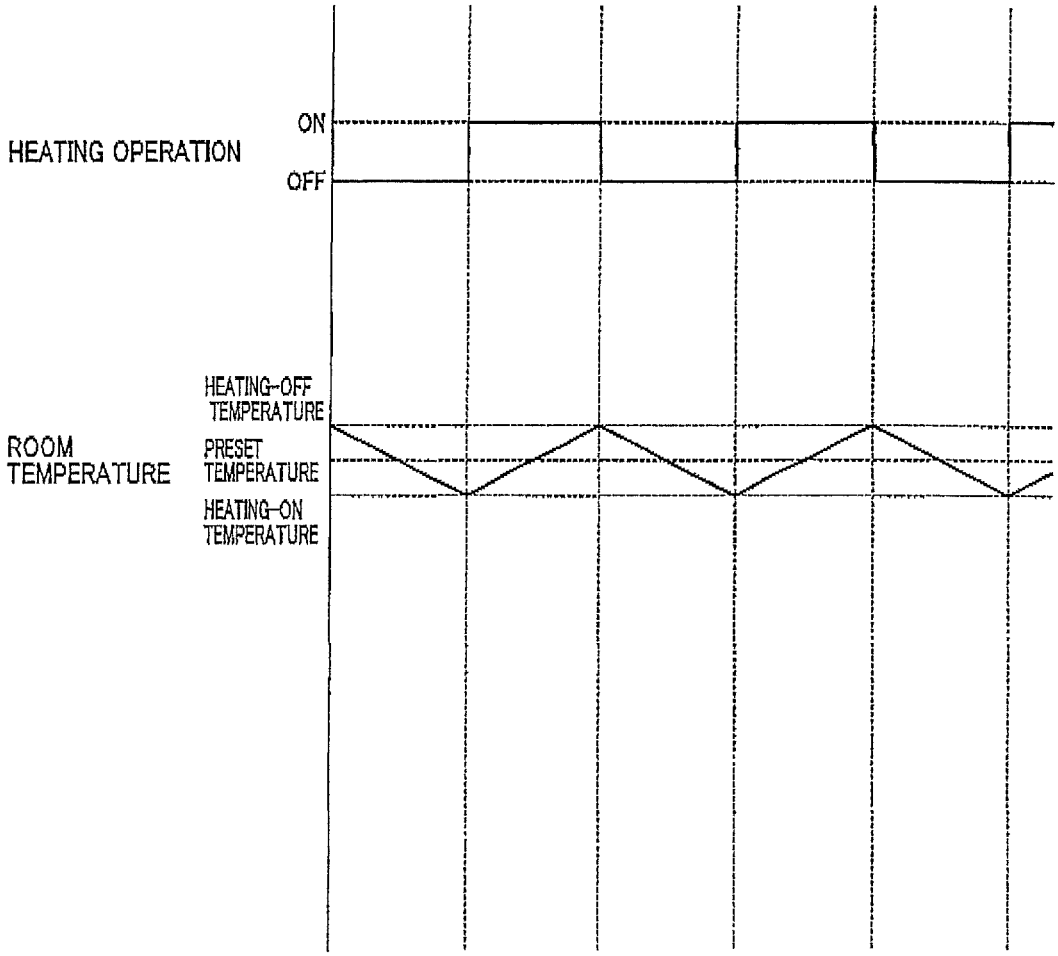
FIG. 5 is a schematic diagram of a relationship between operation of an air-conditioning unit and changes in room temperature.

FIG. 5 shows a relationship between heating operation of the room 12 and the room temperature. As indicated in FIG. 5, when the heating operation is performed, the temperature of the room 12 changes over time between a heating-ON temperature and a heating-OFF temperature with the preset temperature therebetween.

For example, when the preset temperature is set to 26° C., the heating-ON temperature is 25.5° C. and the heating-OFF temperature is 26.5° C. In other words, the control device 17 receives the preset temperature as 26° C. from the room terminal 42. Then, when the room temperature that is detected by the temperature sensor 47 of the room terminal 42 becomes 25.5° C., the temperature control unit 63 turns on the heating operation.

The warm air generated by the air-conditioning unit 15 is supplied to the room 12. In addition, when the room temperature detected by the temperature sensor 47 reaches 26.5° C., the temperature control unit 63 turns off the heating operation. The supply of warm air to the room 12 is stopped. As a result, the temperature of the room 12 changes over time between the heating-on temperature and the heating-off temperature. When the heating operation is turned on, the temperature control unit 63 turns on the air-conditioning unit 15 and sets the damper 25 to open.

In addition, when the heating operation is turned off, the temperature control unit 63 turns off the air-conditioning unit 15 or sets the damper 25 to be closed. When the heating operation is turned off, the temperature control unit 63 may turn off the air-conditioning unit 15 and set the damper 25 to be closed.

In addition, the temperature difference between the preset temperature and the heating-on temperature or the heating-off temperature is not limited to 0.5° C. The temperature difference can be set arbitrarily. In addition, the temperature difference may differ between the ON side and the OFF side.

On the other hand, when cooling is performed, the room temperature changes over time between a cooling-on temperature and a cooling-off temperature with the preset temperature therebetween. For example, when the preset temperature is set to 26° C., the cooling-on temperature is 26.5° C. and the cooling-off temperature is 25.5° C.

When the room temperature detected by the temperature sensor 47 of the room terminal 42 becomes 26.5° C., the temperature controlling unit 63 turns on the cooling operation. The cool air generated by the air-conditioning unit 15 is supplied to the room 12. In addition, when the room temperature detected by the temperature sensor 47 becomes 25.5° C., the temperature control unit 63 turns off the cooling operation. The supply of cool air to the room 12 is stopped.

(Switched Mounting)

Figure 6:
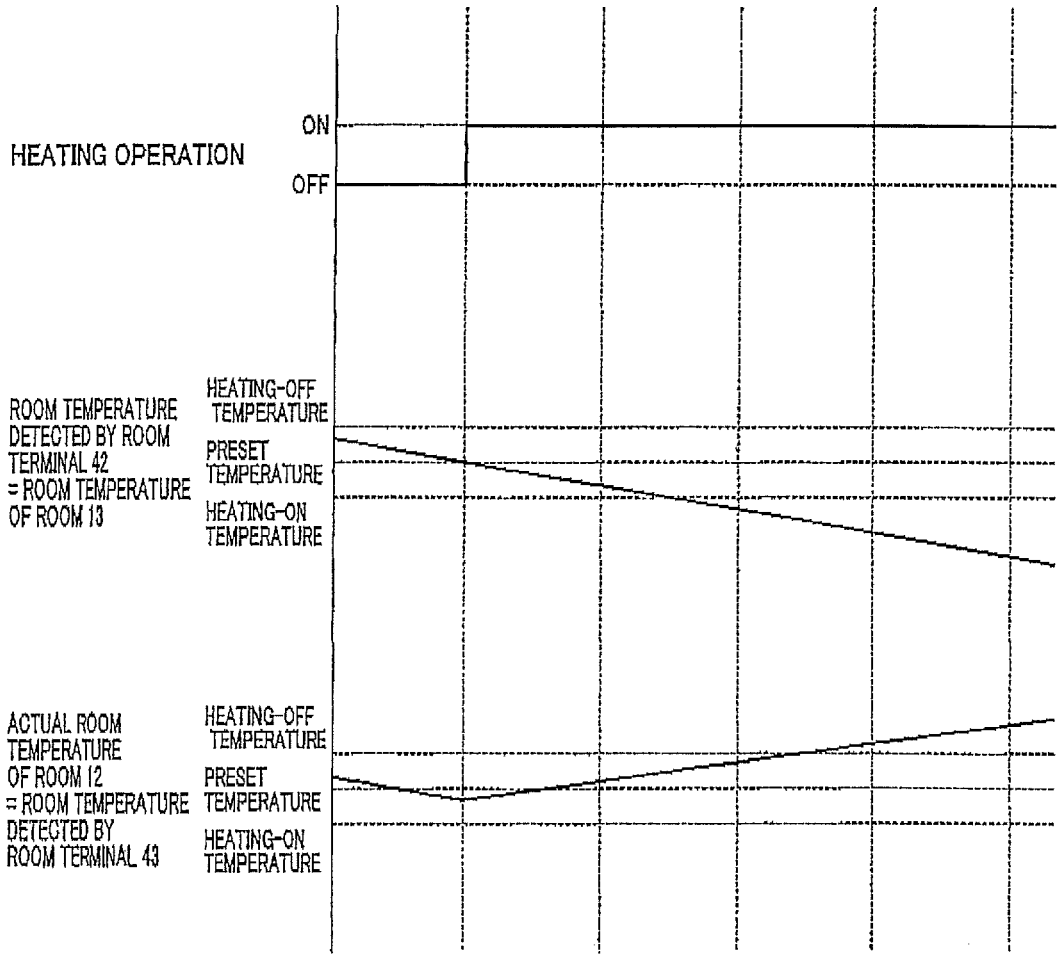
FIG. 6 is a schematic diagram of a relationship between operation of the air-conditioning unit and changes in room temperature when room terminals are switched.

Next, an example in which the room terminal 42 and the room terminal 43 are switched during a heating operation will be described with reference to FIG. 6. In other words, in this instance, the room terminal 42 is switched to the room 13 rather than the room 12 to which the room terminal 42 is dedicated.

When the heating operation is being performed, the room temperatures decrease with the elapse of time in both the room 12 and the room 13. The room terminal 42 has been moved from the room 12 to the room 13. The room terminal 42 detects the temperature of the room 13 because of this. In addition, the room terminal 43 detects the temperature of the room 12.

When the temperature of the room 13 detected by the room terminal 42 decreases and reaches the heating-on temperature, the control device 17 performs heating of the room 12. However, in this case, the room terminal 42 has been switched with the room terminal 43 and is mounted in the room 13. Therefore, the control device 17 judges that the temperature of the room 13 detected by the room terminal 42 is the temperature of the room 12. The control device 17 performs heating of the room 12. If the room terminal 42 were mounted in the room 12 as intended, the control device 17 would stop heating the room 12 when the temperature of the room 12 reached the heating-off temperature.

However, the room terminal 42 that is mounted in the room 13 detects the temperature of the room 13. The room 13 is not being heated. As a result, the temperature of the room 13 decreases over time. Therefore, the temperature of the room 13 detected by the room terminal 42 continues to decrease and does not reach the heating-off temperature. As a result, the control device 17 does not stop heating the room 12. The control device 17 erroneously recognizes the temperature of the room 13 detected by the room terminal 42 as the temperature of the room 12. The control device 17 continues heating the room 12. As a result, the room 12 continues to be heated even when the heating-off temperature is reached. The temperature of the room 12 continues to increase.

On the other hand, the room terminal 43 is mounted in the room 12 and detects the temperature of the room 12. The room 12 is being continuously heated. As a result, the temperature of the room 12 increases with the elapse of time. Therefore, the temperature of the room 12 detected by the room terminal 43 continues to increase and does not reach the heating-on temperature. As a result, the control device 17 does not resume heating the room 13.

The control device 17 erroneously recognizes the temperature of the room 12 detected by the room terminal 43 as the temperature of the room 13. The control device 17 continues not heating the room 13. As a result, even when the temperature of the room 13 falls below the heating-on temperature, heating is not started. The temperature of the room 13 continues to decrease.

(Correspondence Judgment)

Correspondence judgment performed by the correspondence judging unit 64 will be described with reference to FIG. 7. Here, the room 12 is the specified room and the room terminal 42 is a specified room terminal.

Figure 7:
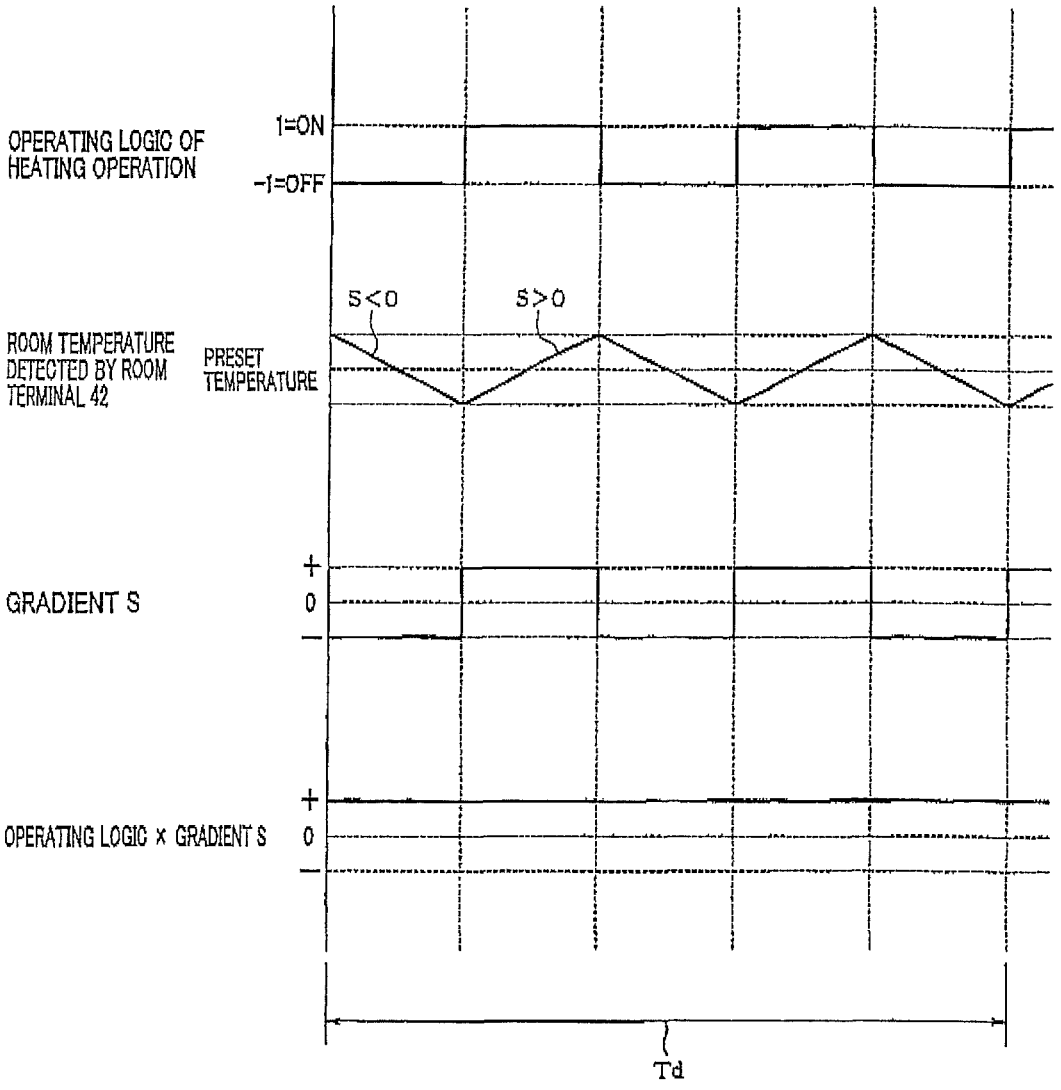
FIG. 7 is an explanatory diagram of the basis on which a correspondence judging unit judges normal mounting of a room terminal in the central air-conditioning system according to the embodiment.

As shown in FIG. 7, the control device 17 repeats ON and OFF of the heating operation for the room 12. The correspondence judging unit 64 stores an operating logic, or in other words, ON and OFF of the room 12 by the control device 17. The correspondence judging unit 64 stores the operating logic in the RAM of the control unit 60 or the like. In this instance, the correspondence judging unit 64 stores 1 as heating operation ON and −1 as heating operation OFF, for example. The correspondence judging unit 64 may store the operating logic in a separate storage medium, rather than the RAM of the control unit 60.

The correspondence judging unit 64 accumulates pieces of information on the room temperatures detected by the room terminal 42. Then, the correspondence judging unit 64 calculates a gradient S of the accumulated changes in room temperature detected by the room terminal 42. According to the present embodiment, the correspondence judging unit 64 calculates whether the gradient S is S<0 or S>0, or in other words, whether the gradient S is positive or negative.

In other words, when the room temperature detected by the room terminal 42 is decreasing, the gradient S is S<0. In addition, when the room temperature detected by the room terminal 42 is increasing, the gradient S is S>0. In this way, the correspondence judging unit 64 calculates whether the gradient S is S<0 or S>0.

Furthermore, the correspondence judging unit 64 calculates a product of the operating logic and the gradient S. As described above, the operating logic (operating state) is set to 1 when. ON and −1 when OFF. Therefore, the product of the operating logic and the gradient S is positive "+" both when the operating logic is −1 and the gradient S is S<0; and also when the operating logic is +1 and the gradient S is S>0.

The correspondence judging unit 64 calculates the calculated product as an integrated value A of a preset duration Td that has been set in advance. The correspondence judging unit 64 compares the calculated integrated value A and preset values Ad and −Ad that have been set in advance. When judged that the integrated value A is greater than the preset value Ad, or in other words, when A>Ad, the correspondence judging unit 64 judges that the room terminal 42 is mounted in the room 12 during heating.

Figure 8:
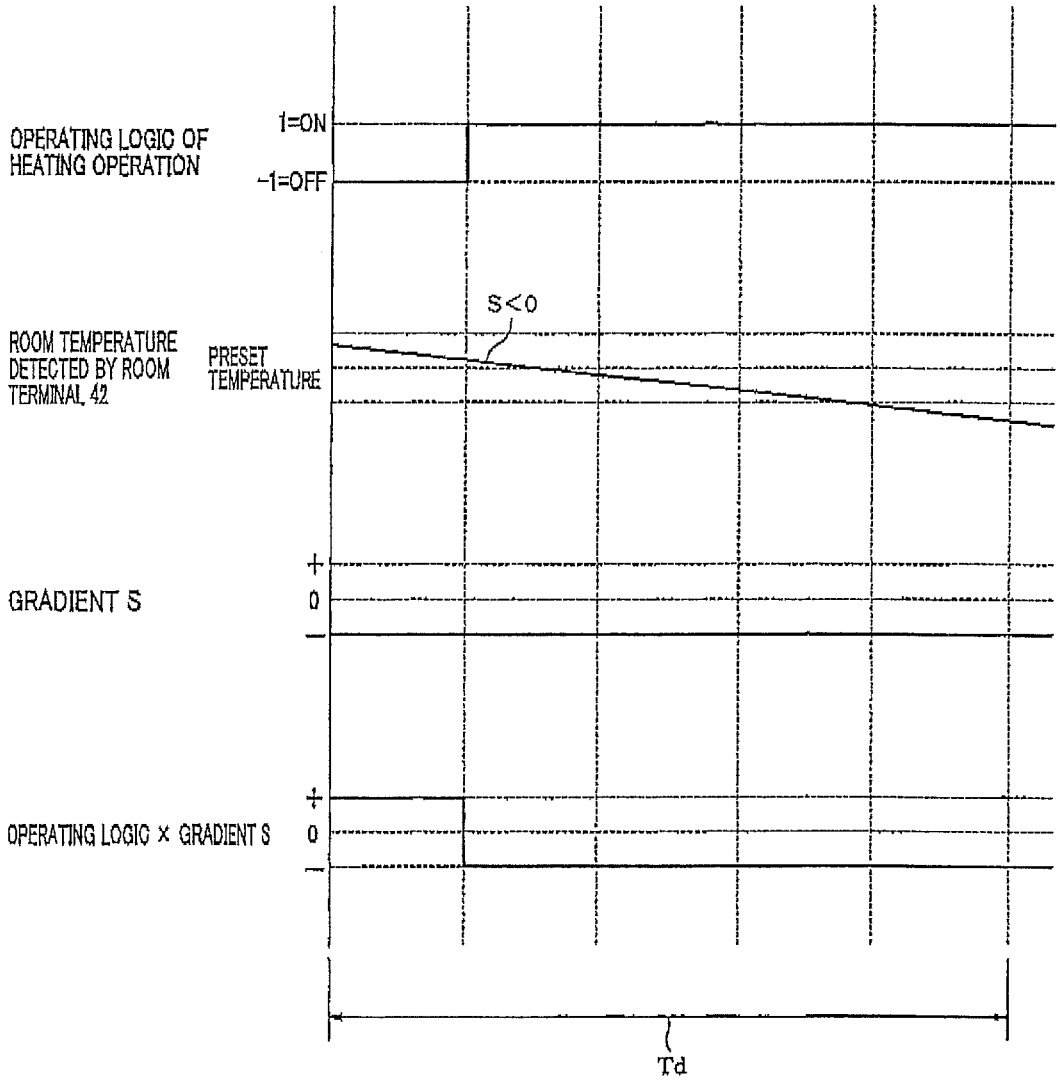
FIG. 8 is an explanatory diagram of the basis on which the correspondence judging unit judges that room terminals have been switched in the central air-conditioning system according to the embodiment.

On the other hand, when judged that the integrated value A is less than the preset value −Ad, or in other words, when A<−Ad as shown in FIG. 8, the correspondence judging unit 64 judges that the room terminal 42 is not mounted in the room 12 during heating. In other words, when the room terminal 42 is not mounted in the room 12, the room temperature detected by the room terminal 42 continues to decrease. Therefore, the integrated value A of the preset duration Td becomes A<−Ad.

According to the present embodiment, the operating logic is set to −1 when OFF. Therefore, the product of the operating logic and the gradient S becomes positive "+" even when the room temperature detected by the room terminal 42 decreases, or in other words, the gradient S is S<0. Therefore, the value of the product is ordinarily calculated as the integrated value A during the preset duration Td.

As a result, an instance in which the room terminal 42 is normally mounted as shown in FIG. 7 and an instance in which the room terminal 42 is erroneously mounted as shown in FIG. 8 can be accurately judged. The operating logic may be arbitrarily changed. For example, the operating logic may be set to 1 when ON and 0 when OFF.

During cooling, the concept is the same. However, the positive and negative of the preset values are inversed. In other words, when judged that the integrated value A is less than the preset value −Ad, or in other words, A<−Ad, the correspondence judging unit 64 judges that the room terminal 42 is mounted in the room 12 during cooling. In addition, when judged that the integrated value A is greater than the preset value Ad, or in other words, A>Ad, the correspondence judging unit 64 judges that the room terminal 42 is not mounted in the room 12 during cooling.

Here, the preset duration Td is arbitrarily set based on the characteristics of the room to be air-conditioned, the capabilities of the air-conditioning unit 15, and the like. For example, it can be considered that a temperature change of ±10° C. from the preset temperature will cause the user discomfort. Therefore, the preset duration Td corresponds to the amount of time required for a temperature change of 10° C. from the preset temperature to occur.

The typical central air-conditioning system 10 has the capability of causing a temperature change of 2.5° C./h to 5.0° C./h. Therefore, the preset duration Td is preferably set to one to four hours depending on the size of the room and the capabilities of the air-conditioning unit 15. In addition, a period during which the overall central air-conditioning system 10 is turned off is not included in the preset duration Td.

In addition, −Ad≤A≤Ad may apply to the integrated value A calculated by the correspondence judging unit 64. For example, in an instance in which a door for entering and exiting the room is open or in which direct sunlight enters the room, a prompt change in room temperature may not occur even when heating or cooling of the room is performed.

Therefore, when the integrated value A is −Ad≤A≤Ad, the correspondence judging unit 64 determines that the duration is insufficient for making a judgment. The correspondence judging unit 64 extends the preset duration Td. As a result, the effect of a sudden, short-term change in room temperature can be eliminated. The relationships between the rooms 12, 13, and 14 and the room terminals 42, 43, and 44 can be accurately judged.

Next, a flow of processes performed by the central air-conditioning system 10, configured as described above, will be described with reference to FIG. 9. An example in which heating is performed is shown in FIG. 9.

When the central air-conditioning system 10 is turned on, the control device 17 judges whether or not any of the room terminals 42, 43, and 44 has been removed (step S101). When the respective movement detecting units 53 of the room terminals 42, 43, and 44 detect removal from the respective rooms 12, 13, and 14 of the respective terminals, the room terminals 42, 43, and 44 give notification of removal to the control device 17 via the communication unit 52.

The control device 17 receives the notification of removal from any of the room terminals 42, 43, and 44, thereby recognizing the removal. When judged that none of the room terminals 42, 43, and 44 has been removed (NO at step S101), the control device 17 waits until any of the room terminals 42, 43, and 44 is removed.

When judged that any of the room terminals 42, 43, and 44 has been removed (YES at step S101), the control device 17 sets the corresponding room 12, 13, or 14 as the specified room (step S102). The control device 17 sets the relevant room terminal 42, 43, or 44 as the specified room terminal (step S103).

For example, when the room terminal 42 of the room 12 has been removed, the control device 17 sets the room 12 as the specified room. The control device 17 also sets the room terminal 42 as the specified room terminal. The control device then judges whether or not the removed room terminal 42, 43, or 44 is reattached (step S104). When judged that the room terminal 42, 43, or 44 has not been reattached (NO at step S104), the control device 17 waits until the room terminal 42, 43, or 44 is reattached.

When judged that the room terminal 42, 43, or 44 is reattached (YES at step S104), the correspondence judging unit 64 stores the operating logic of the specified room (step S105). The correspondence judging unit 64 stores the operating logic of the specified room set at step S102, or in other words, whether the heating operation is ON or OFF, to 1 when ON and −1 when OFF.

For example, when the room 12 is the specified room, the correspondence judging unit 64 stores the operating logic for the room 12. In addition, the correspondence judging unit 64 also collects the information on the room temperatures detected by the specified room terminal set at S103 (step S106).

The correspondence judging unit 64 calculates the gradient S of the changes in room temperature from the information on the room temperatures detected at step S106 (step S107). Furthermore, the correspondence judging unit 64 integrates the product of the operating logic acquired at step S105 and the gradient S calculated at step S107 with the preset duration Td, and calculates the value as the integrated value A (step S108).

The correspondence judging unit 64 judges whether or not the integrated value A calculated at step S108 is greater than the preset value Ad (step S109). In other words, the correspondence judging unit 64 judges whether or not A>Ad.

When judged at step S109 that A>Ad (YES at step S109), the correspondence judging unit 64 judges that the specified room terminal is mounted in the specified room (step S110). The correspondence judging unit 64 then ends the process. In other words, in an instance in which the room terminal 42 of the room 12 has been removed, the correspondence judging unit 64 judges that the room terminal 42 has been reattached to the room 12.

On the other hand, when judged that A is not greater than Ad (NO at step S109), the correspondence judging unit 64 judges whether or not the integrated value A is less than the preset value −Ad (step S111). In other words, the correspondence judging unit 64 judges whether or not A<−Ad.

When judged at step S111 than A<−Ad (YES at step S111), the correspondence judging unit 64 judges that the specified room terminal is not mounted in the specified room (step S112). In other words, in an instance in which the room terminal 42 of the room 12 has been removed, the correspondence judging unit 64 judges that the room terminal 42 has not been returned to the room 12.

When judged at step S112 than the specified room terminal is not mounted in the specified room, the air-conditioning stopping unit 65 stops air-conditioning the specified room (step S113). As a result, excessive heating of the specified room is prevented.

In addition, when judged at step S111 that A is not less than −Ad (NO at step S111), the correspondence judging unit 64 does not judge the correlation between the specified room and the specified room terminal (step S114). In other words, the correspondence judging unit 64 judges that the calculated integrated value A is −Ad≤A≤Ad.

The correspondence judging unit 64 judges that the accumulation of data is insufficient for judging the relationship between the specified room and the specified room terminal. Therefore, the correspondence judging unit 64 extends the preset duration Td and returns to step S105.

As described above, according to the embodiment, the correspondence judging unit 64 judges whether or not the specified room terminal is mounted in the specified room based on the operating logic that is the transition of control of the distribution mechanism 16 in the specified room and the changes in temperature of the specified room detected by the specified room terminal.

Then, when the correspondence judging unit 64 judges that the specified room terminal is not mounted in the specified room, the air-conditioning stopping unit 65 stops air-conditioning the specified room. As a result, if there is an error in the mounting of any of the room terminals 42, 43, and 44, the air-conditioning of the specified room is terminated. Therefore, excessive or insufficient air-conditioning of the specified room can be prevented.

In addition, according to the embodiment, the respective movement detecting units 53 of the room terminals 42, 43, and 44 judge whether or not the room terminals 42, 43, and 44 have been removed from the corresponding rooms 12, 13, and 14. When any of the movement detecting units 53 judge that the respective room terminal 42, 43, or 44 has been removed, the control device 17 sets the corresponding room 12, 13, or 14 as the specified room and the room terminal 42, 43, or 44 corresponding to the specified room as the specified room terminal.

In other words, the control device 18 judges whether or not the specified room terminal is set in the specified room with the removal of the room terminal 42, 43, or 44 as a trigger. Unless there is an initial mounting defect, the specified room terminal will not detect the temperature of a room other than the specified room, as long as the specified room terminal is attached to the specified room.

On the other hand, as a result of the specified room terminal being removed from the specified room, a possibility arises that the specified room terminal is switched with the room terminal of another room. Therefore, the control device 17 judges whether or not the specified room terminal and the specified room match, with the removal of the room terminal 42, 43, or 44 as a trigger. The removal of the room terminal 42, 43, or 44 leads to movement of the room terminal 42, 43, or 44. Therefore, unnecessary control can be omitted.

According to the embodiment, the preset temperature and the detected room temperature are communicated wirelessly between each room terminal 42, 43, and 44 and the control device 17. When the room terminals 42, 43, and 44 and the control device 17 are connected wirelessly, compared to a wired connection, the possibility increases that the room terminals 42, 43, and 44 are switched to a room other than the respective rooms 12, 13, and 14 to which the room terminals 42, 43, and 44 are dedicated.

According to the present embodiment, even when the room terminals 42, 43, and 44 and the control device 17 are connected wirelessly and switching among the room terminals 42, 43, and 44 tends to occur, erroneous correspondence between the room terminals 42, 43, and 44 and the rooms 12, 13, and 14 can be prevented with certainty. Therefore, excessive or insufficient air-conditioning of the specified roan can be prevented.

According to the embodiment, whether or not the specified room terminal is mounted in the specified room is judged based on information accumulated over a preset duration that has been set in advance. Therefore, the effects of changes in temperature caused by disturbances in the specified room are reduced.

The temperatures of the rooms 12, 13, and 14, including the specified room, change as a result of disturbances, such as a door being opened or direct sunlight entering the room, in addition to air-conditioning. If whether or not the specified room terminal is mounted in the specified room is judged on the basis of short-term changes in temperature, the judgment may be affected by these disturbances.

Therefore, the effects of disturbances are eliminated by use of information accumulated over the preset duration Td. As a result, the relationship between the specified room terminal and the specified room can be judged with high accuracy. Excessive and insufficient air-conditioning of the specified room can be prevented with high accuracy.

Other Embodiments

The present invention described above is not limited to the above-described embodiment. The present invention can be applied to various embodiments without departing from the spirit of the invention.

According to the above-described embodiment, an example is described in which air-conditioning of the specified room is stopped when the specified room and the specified room terminal do not correspond. The process is then ended. However, in addition to air-conditioning of the specified room being stopped when the specified room and the specified room terminal do not correspond, the notifying means may be provided that gives notification thereof.

Specifically, the correspondence judging unit 64 may display a warning or the like stating that "the mounting position is wrong" in the display units 48 of the room terminals 42, 43, and 44. In other words, the display unit 48 is equivalent to a notifying means in the scope of claims. The warning is not limited to a visual warning.

The warning may be an audio warning, such as a buzzer sound. In addition, the warning may be displayed in the control device 17 in addition to the room terminals 42, 43, and 44. Furthermore, the central air-conditioning system 11 may be configured such as to be communicably connected to an external mobile terminal, such as a tablet or a smartphone. The central air-conditioning system 10 may notify the external mobile terminal of the erroneous correspondence between the specified room and the specified room terminal.

In this way, according to another embodiment, when the specified room terminal is not mounted in the specified room after the process at step S113 shown in FIG. 9, the notifying means gives notification thereof. As a result, the user can be notified that the specified room is not being air-conditioned.

In addition, according to the above-described embodiment, an example is described in which the correlations between the room terminals 42, 43, and 44 and the rooms 12, 13, and 14 are judged with the removal of the room terminals 42, 43, and 44 as the trigger. However, a configuration is possible in which the correlations between the room terminals 42, 43, and 44 and the rooms 12, 13, and 14 are judged at all times, without using the removal of the room terminals 42, 43, and 44 as the trigger. In other words, a configuration is possible in which the processes at step S105 and subsequent steps in FIG. 9 are performed at all times.

For example, during installation of the central air-conditioning system 10, a situation may be considered in which the room terminals 42, 43, and 44 are switched as a result of initial error. In this instance, when removal of the room terminals 42, 43, and 44 serves as the trigger, a lengthy amount of time may be required until the correlations between the room terminals 42, 43, and 44 and the rooms 21, 13, and 14 are improved.

Therefore, when the central air-conditioning system 10 is turned ON, as a result of the configuration being used in which the processes at step S105 and subsequent steps shown in FIG. 9 are performed, the correlations between the room terminals 42, 43, and 44 and the rooms 12, 13, and 14 can be improved at an early stage.

In addition, according to the above-described embodiment, an example is described in which the room terminals 42, 43, and 44 and the control device 17 are connected wirelessly. However, the room terminals 42, 43, and 44 and the control device 17 may be connected by wires. When the room terminals 42, 43, and 44 and the control device 17 are connected by wires, wiring error may occur.

Therefore, as a result of the present embodiment being applied to the configuration in which the room terminals 42, 43, and 44 and the control device 17 are connected by wires, the error in correspondence between the room terminals 42, 43, and 44 and the rooms 12, 13, and 14 can be improved at an early stage.

Furthermore, the number of rooms in the house 11 is not limited to three. The number of rooms may be arbitrarily set.

What is claimed is:

1. A central air-conditioning system comprising:

a single air-conditioning unit that generates warm air or cool air;

a distribution mechanism that distributes warm air or cool air generated by the air-conditioning unit to a plurality of rooms in a house;

a control device that controls the distribution mechanism to adjust a temperature of each room; and a plurality of room terminals that are each provided as a dedicated device for one of the plurality of rooms, each of the room terminals receiving an input of a preset temperature for the room and detecting a temperature of the room, and outputting the received preset temperature and the detected room temperature to the control device, the control device comprising a processor, the processor configured to:

judge, for a specified room among the plurality of rooms and a specified room terminal dedicated to the specified room, whether or not the specified room terminal is mounted in the specified room, based on a transition of control of the distribution mechanism in the specified room and a change in temperature detected by the specified room terminal;

stop air-conditioning the specified room when the processor judges that the specified room terminal is not mounted in the specified room corresponding to the specified room terminal;

judge whether or not the specified room terminal is mounted in the specified room, based on information accumulated in a specified preset duration, the information including information indicating whether an on/off operation of air-conditioning of the specified room via the distribution mechanism is ON or OFF, and information indicating whether a gradient of change in temperature of the specified room detected by any of the room terminals is positive or negative;

use operating logic having positive and negative values, one of the positive and negative values indicating one of ON and OFF of the on/off operation of air-conditioning, the other of the positive and negative values indicating the other of ON and OFF of the on/off operation of air-conditioning;

determine whether the gradient of change in temperature of the specified room detected by any of the room terminals is positive or negative;

calculate a product of the operating logic and the gradient; and judge whether or not the specified room terminal is mounted in the specified room by comparing a calculation result of the product of the operating logic and the gradient with a preset value.

2. The central air-conditioning system according to claim 1, wherein:

each of the room terminals comprises a detecting unit that judges whether or not each of the room terminals has been removed from the room corresponding to each of the room terminals; and the control device sets the relevant room as the specified room and any of the room terminals corresponding to the specified room as the specified room terminal, when the detecting unit detects that any of the room terminals has been removed.

3. The central air-conditioning system according to claim 2, wherein:

each of the room terminals wirelessly transmits the preset temperature and the detected temperature to the control device.

4. The central air-conditioning system according to claim 3, wherein the control device further comprises a notifying means that, when the processor judges that the specified room terminal is not mounted in the specified room corresponding to the specified room terminal, notifies that the specified room terminal is not mounted in the specified room corresponding to the specified room terminal.

5. The central air-conditioning system according to claim 1, wherein:

each of the room terminals wirelessly transmits the preset temperature and the detected temperature to the control device.

6. The central air-conditioning system according to claim 1, wherein the control device further comprises a notifying means that, when the processor judges that the specified room terminal is not mounted in the specified room corresponding to the specified room terminal, notifies that the specified room terminal is not mounted in the specified room corresponding to the specified room terminal.

7. The central air-conditioning system according to claim 1, wherein the processor is configured to:

store operating logic depending on the on/off operation of air-conditioning for the specified preset duration;

accumulate the temperature of the specified room for the specified preset duration;

calculate a gradient of change in the accumulated temperature;

integrate a product of the operating logic and the gradient in the specified preset duration to produce an integrated value; and judge whether or not the specified room terminal is mounted in the specified room, by comparing the integrated value with a preset value.

8. A control device for a central air-conditioning system, the central air-conditioning system comprising:

a single air-conditioning unit that generates warm air or cool air;

a distribution mechanism that distributes warm air or cool air generated by the air-conditioning unit to a plurality of rooms in a house;

a plurality of room terminals that are each provided as a dedicated device for one of the plurality of rooms, each of the room terminals receiving an input of a preset temperature for the room and detecting a temperature of the room, and outputting the received preset temperature and the detected room temperature to the control device, the control device controlling the distribution mechanism to adjust a temperature of each room, the control device comprising a processor, the processor being configured to:

judge, for a specified room among the plurality of rooms and a specified room terminal dedicated to the specified room, whether or not the specified room terminal is mounted in the specified room, based on a transition of control of the distribution mechanism in the specified room and a change in temperature detected by the specified room terminal;

stop air-conditioning the specified room when judged that the specified room terminal is not mounted in the specified room corresponding to the specified room terminal;

judge whether or not the specified room terminal is mounted in the specified room, based on information accumulated in a specified preset duration, the information including information indicating whether an on/off operation of air-conditioning of the specified room via the distribution mechanism is ON or OFF, and information indicating whether a gradient of change in temperature of the specified room detected by any of the room terminals is positive or negative;

use operating logic having positive and negative values, one of the positive and negative values indicating one of ON and OFF of the on/off operation of air-conditioning, the other of the positive and negative values indicating the other of ON and OFF of the on/off operation of air-conditioning;

determine whether the gradient of change in temperature of the specified room detected by any of the room terminals is positive or negative;

calculate a product of the operating logic and the gradient; and judge whether or not the specified room terminal is mounted in the specified room by comparing a calculation result of the product of the operating logic and the gradient with a preset value.

9. The control device according to claim 8, the processor being configured to:

store operating logic depending on the on/off operation of air-conditioning for the specified preset duration;

accumulate the temperature of the specified room for the specified preset duration;

calculate a gradient of change in the accumulated temperature;

integrate a product of the operating logic and the gradient in the specified preset duration to produce an integrated value; and judge whether or not the specified room terminal is mounted in the specified room, by comparing the integrated value with a preset value.

10. A control method for a central air-conditioning system, the central air-conditioning system comprising:

a single air-conditioning unit that generates warm air or cool air;

a distribution mechanism that distributes warm air or cool air generated by the air-conditioning unit to a plurality of rooms in a house;

a control device that controls the distribution mechanism to adjust a temperature of each room; and a plurality of room terminals that are each provided as a dedicated device for one of the plurality of rooms, each of the room terminals receiving an input of a preset temperature for the room and detecting a temperature of the room, and outputting the received preset temperature and the detected room temperature to the control device, the control method comprising:

judging, by the control device, for a specified room among the plurality of rooms and a specified room terminal dedicated to the specified room, whether or not the specified room terminal is mounted in the specified room, based on a transition of control of the distribution mechanism in the specified room and a change in temperature detected by the specified room terminal;

judging, by the control device, whether or not the specified room terminal is mounted in the specified room, based on information accumulated in a specified preset duration, the information including information indicating whether an on/off operation of air-conditioning of the specified room via the distribution mechanism is ON or OFF, and information indicating whether a gradient of change in temperature of the specified room detected by any of the room terminals is positive or negative;

stopping, by the control device, air-conditioning the specified room when judged that the specified room terminal is not mounted in the specified room corresponding to the specified room terminal;

using operating logic having positive and negative values, one of the positive and negative values indicating one of ON and OFF of the on/off operation of air-conditioning, the other of the positive and negative values indicating the other of ON and OFF of the on/off operation of air-conditioning;

determining whether the gradient of change in temperature of the specified room detected by any of the room terminals is positive or negative;

calculating a product of the operating logic and the gradient; and judging whether or not the specified room terminal is mounted in the specified room by comparing a calculation result of the product of the operating logic and the gradient with a preset value.

11. The control method according to claim 10, wherein the judging step comprises storing, by the control device, operating logic depending on the on/off operation of air-conditioning for the specified preset duration;

accumulating, by the control device, the temperature of the specified room for the specified preset duration;

calculating, by the control device, a gradient of change in the accumulated temperature;

integrating, by the control device, a product of the operating logic and the gradient in the specified preset duration to produce an integrated value; and judging, by the control device, whether or not the specified room terminal is mounted in the specified room, by comparing the integrated value with a preset value.

* * * * *